US006698861B1

(12) United States Patent
Drake

(10) Patent No.: US 6,698,861 B1
(45) Date of Patent: Mar. 2, 2004

(54) SPOT SIZE NOISE TO MINIMIZE STITCH ERROR PERCEPTION

(75) Inventor: Donald J. Drake, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/462,443

(22) Filed: Jun. 16, 2003

(51) Int. Cl.[7] ..... B41J 2/205; B41J 2/145; B41J 2/15

(52) U.S. Cl. ..... 347/15; 347/41

(58) Field of Search ..... 347/15, 41, 19, 347/43; 358/1.9, 1.1

(56) References Cited

U.S. PATENT DOCUMENTS 5,192,959 A 3/1993 Drake et al. ..... 346/140 R
5,198,054 A 3/1993 Drake et al. ..... 156/64
6,185,002 B1 * 2/2001 Askeland et al. ..... 358/1.8
6,257,699 B1 7/2001 Tracy et al. ..... 347/40
6,338,544 B1 1/2002 Drake et al. ..... 347/41
6,441,922 B1 * 8/2002 Askeland et al. ..... 358/1.9

* cited by examiner

*Primary Examiner*—Thinh Nguyen
(74) *Attorney, Agent, or Firm*—Perman & Green, LLP

(57) ABSTRACT

In a technique for obscuring the stitch error perceived the eye of a viewer, a first plurality of drops of fluid are ejected in a first firing sequence at a medium in a first swath from a print head including at least one die having a plurality of nozzles while moving in a first direction relative to the medium. Thereafter, the medium is advanced in a second direction substantially perpendicular to the first direction. The print head is again moved in the first direction and a second plurality of drops of the fluid are fired at the medium in a second swath adjacent the first swath. A controller randomly modulates the spot size resulting from the drops of the fluid. The stitch error may be a misplacement of the second swath relative to the first swath and the second plurality of drops includes a random variety of drop sizes.

53 Claims, 5 Drawing Sheets

FIG. 2
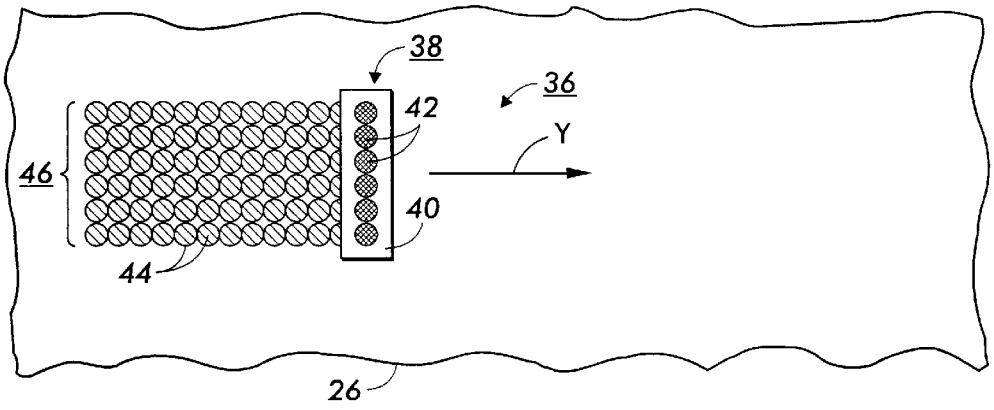
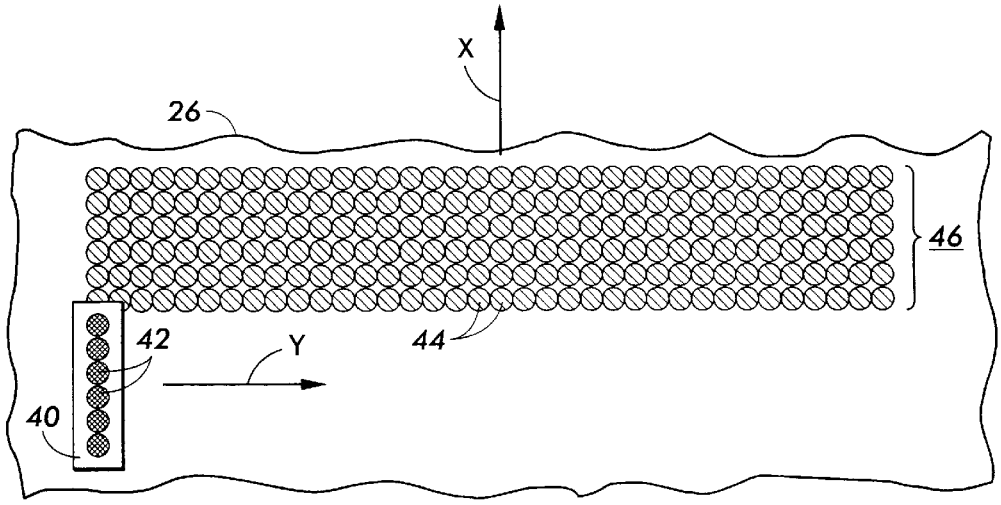
FIG. 3

FIG. 4
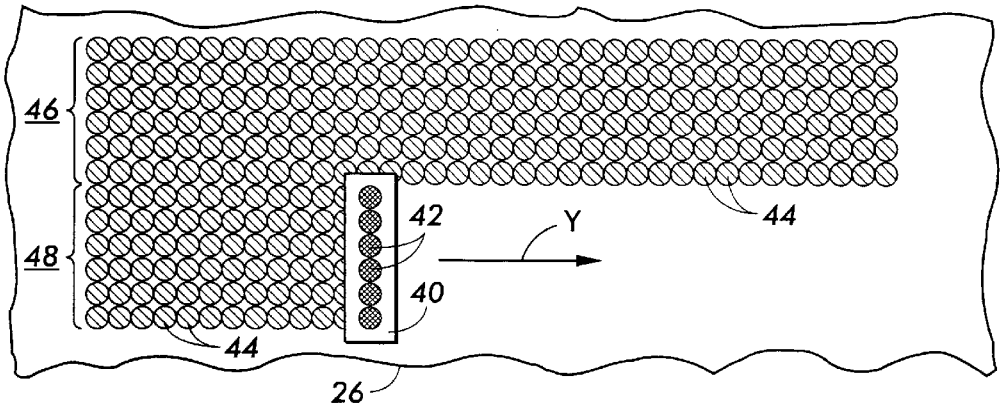
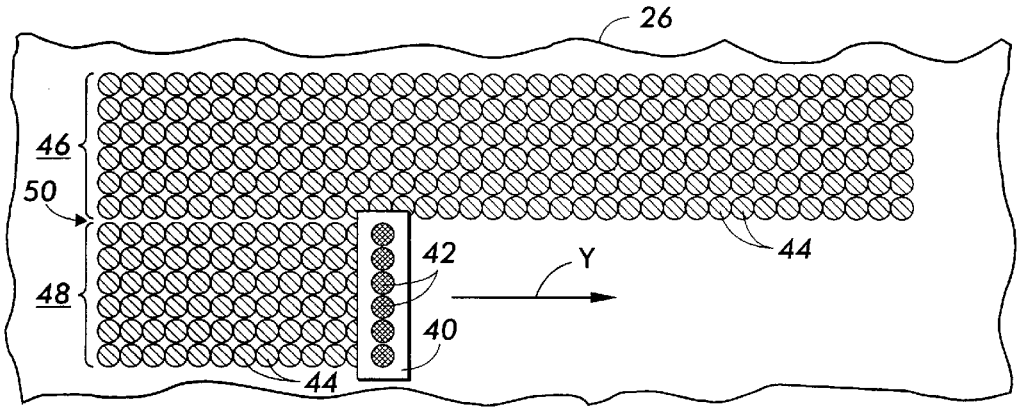
FIG. 5

FIG. 6
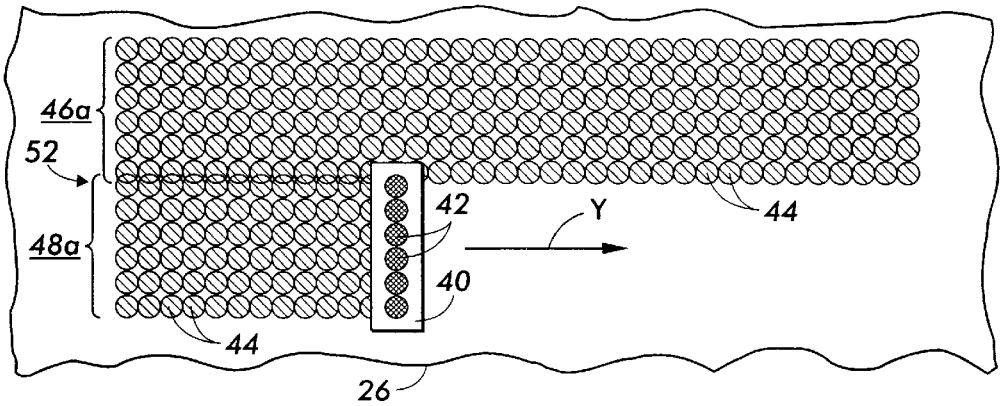
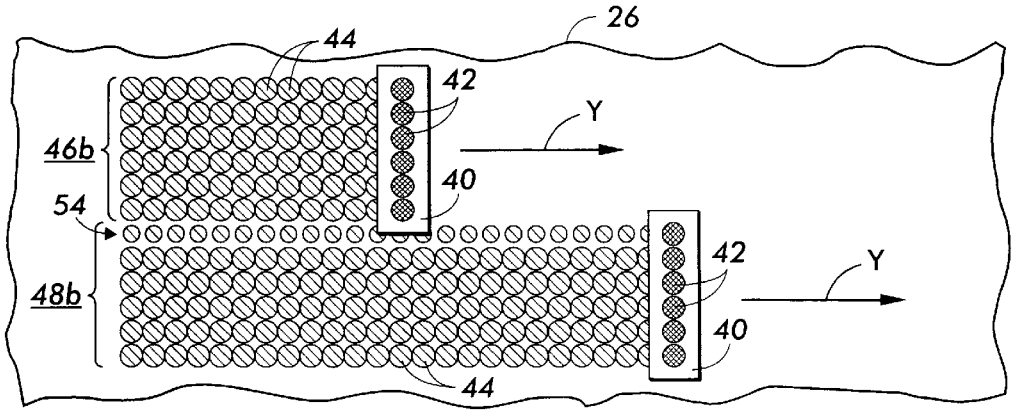
FIG. 7

FIG. 8
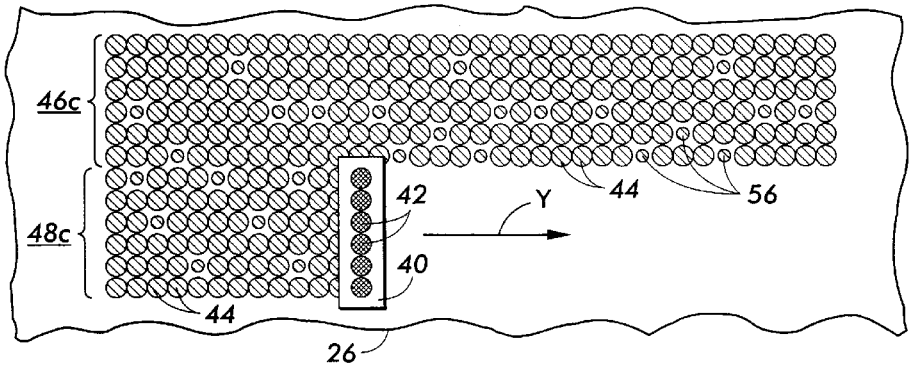
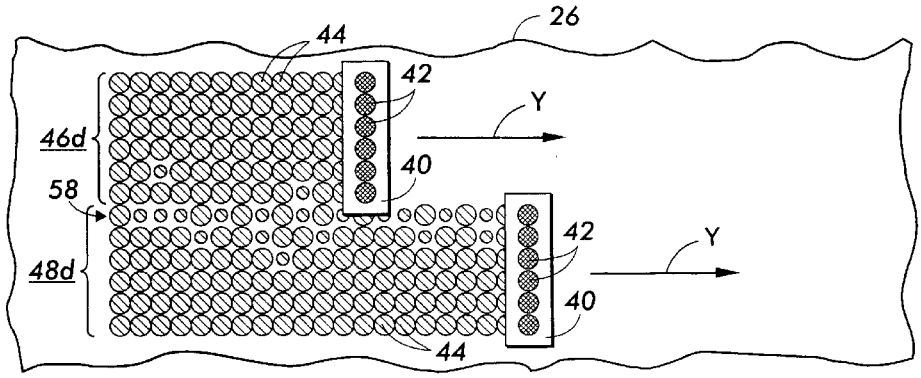
FIG. 9

SPOT SIZE NOISE TO MINIMIZE STITCH ERROR PERCEPTION

BACKGROUND OF THE INVENTION

1. Field of the Invention

The invention relates to stitch errors in printing and, more particularly, to techniques for obscuring stitch errors in printing as perceived by the eye of a viewer.

2. Description of the Prior Art

Fluid ejecting devices such as, for example, ink jet printers, fire drops of fluid from rows of nozzles of an ejection head. The nozzles are usually fired sequentially in groups beginning at one end of the head and continuing to the other end of the head. While the nozzles are being fired, the head moves at a rate designed to advance it by a resolution distance before the next firing sequence begins. If the nozzles are not fired simultaneously, the rows of nozzle are usually tilted so that drops fired from all nozzles land in a substantially vertical column. The ejection head can have one or more dies, each die having a plurality of nozzles. Some devices have ejection heads with only one die, and some devices have ejection heads with multiple dies. If an ejection head has multiple dies, the dies can be, for example, arranged vertically with respect to one another so that the head can eject more drops in a single swath of the head compared to a head having a single die.

The line at which the swaths ejected by adjacent dies, or at which the adjacent swaths, meet is called the stitch joint. Stitch joint error exists when the swaths meeting at the stitch joint meet in such a way that the resulting arrangement of drops at the stitch joint of a printed image is undesirable. Because the spacing of the stitch joint errors is typically ½ to 1 times the printing width of the print head (typically ¼" to ½"), the stitch joint errors are very noticeable because the human eye is very sensitive to this spatial frequency region.

Stitch joint error can be, for example, the result of a gap between the drop of one die adjacent the stitch joint and the drop of an adjoining die adjacent the stitch joint. Such a gap can be the result of the same firing sequence being used for the nozzles of both dies. A similar stitch joint error can be caused when the same nozzle firing sequence is used for each swath of a single die ejection head.

An earlier attempt to reduce stitch joint error is disclosed in commonly assigned U.S. Pat. No. 6,338,544 to Drake et al. The focus of the patent is that stitch joint error can be reduced by firing the nozzles of adjacent dies in a multi-die ejection head using different firing sequences. Similarly, the nozzles of a single die ejection head can be fired using different sequences in adjacent swaths of the ejection head. By firing the nozzles in different sequences as discussed above, the drops at the stitch joint can be positioned closer to each other than they would be if the same firing sequence was used for each die/swath. By reducing the distance between the drops on either side of the stitch joint, the location of the stitch joint becomes less apparent.

It was with knowledge of the foregoing state of the technology that the present invention has been conceived.

SUMMARY OF THE INVENTION

In a technique for obscuring the stitch error perceived by the eye of a viewer, a first plurality of drops of fluid are ejected in a first firing sequence at a medium in a first swath from a print head including at least one die having a plurality of nozzles while moving in a first direction relative to the medium. Thereafter, the medium is advanced in a second direction substantially perpendicular to the first direction. The print head is again moved in the first direction and a second plurality of drops of the fluid are fired at the medium in a second swath adjacent the first swath. A controller randomly modulates the spot size resulting from the drops of the fluid. The stitch error may be a misplacement of the second swath relative to the first swath or a nonuniformity in drop size and at least the second plurality of drops includes a random variety of drop sizes.

This disclosure document describes the use of spot size modulation to introduce noise in the stitch area of two overlapping print die. The noise can be useful in minimizing the perception of defects related to the stitching of the two arrays. These defects can result from non-ideal alignment of the two die, or can result from a difference in optical density (spot size) of the two die. The spot modulation can be achieved by a strategy of multiple drop overlap as in some known thermal ink jet products, or can be achieved by actual drop size modulation as in known piezoelectric ink jet print heads.

One known way to increase the productivity of a single pass mode in a thermal ink jet printer is to use multiple print heads, e.g. increasing the black printing productivity by using two black print heads. However, the precision mechanical alignment of two print heads is difficult and expensive. In addition, if the alignment is less than perfect, a systematic error results that is repeated at the spatial frequency of the print head/so is very visible. An alternate method is to coarsely align the two black print heads and use a checkerboarding scheme where each print head prints part of the pixels, to introduce spatial noise into the overlapped arrays to minimize the perception of the systematic alignment error.

This proposal suggests that another way of minimizing the perception of a stitch defect in the overlap region is by drop modulation. Random drop modulation can introduce noise into the overlap region which will break up the systematic nature of the defect. In addition, if the misregistered stitch is visible as a lighter band, modulating for bigger spots will tend to obscure this defect. In fact, even in butted array strategies (i.e., where array overlapping is not possible) spot modulation can obscure the lighter or darker stitch bands by a complementary compensation. Compensation could be done at the factory or by user selection.

Spot Modulation for other than the purpose of the present invention is commercially achieved by known piezoelectric printers and is also achieved in some print heads by means of prepulse control. It is likely that both piezoelectric and thermal ink jet print head technology will advance the capability of drop size modulation so this technique to introduce noise to obscure systematic defects will become more and more capable.

A primary feature, then, of the present invention is the provision of techniques for obscuring stitch errors in printing as perceived by the eye of a viewer.

Another feature of the present invention is the provision of such a technique which hides stitch errors in overlapping or butted print dies.

Yet another feature of the present invention is the provision of such a technique which uses spot size modulation in the print head, noise being created by random drop modulation in the stitch region which would be used to hide structure from such a stitch region.

Still another feature of the present invention is the provision of such a technique according to which noise is biased toward larger spot sizes for darkening or toward smaller spot sizes for lightening, such that the density matches the desired density in the non stitch region.

Other and further features, advantages, and benefits of the invention will become apparent in the following description taken in conjunction with the following drawings. It is to be understood that the foregoing general description and the following detailed description are exemplary and explanatory but are not to be restrictive of the invention. The accompanying drawings which are incorporated in and constitute a part of this invention, illustrate one of the embodiments of the invention, and together with the description, serve to explain the principles of the invention in general terms. Like numerals refer to like parts throughout the disclosure.

BRIEF DESCRIPTION OF THE DRAWINGS

FIG. 2 is a plan view of print medium such as a sheet of paper upon which a swath of spots have been ejected from a print head using the printing device of FIG. 1;

FIG. 3 is a plan view of print medium such as a sheet of paper depicting a completed swath of spots ejected from a print head using the printing device of FIG. 1, with the print head positioned to produce a second swath adjacent the completed swath;

FIG. 4 is a plan view, similar to FIG. 3, with the print head in the process of producing the second swath adjacent the completed swath;

FIG. 5 is a plan view, similar to FIG. 4, depicting a stitch error in the form of a gap between adjacent swaths;

FIG. 6 is a plan view, similar to FIG. 4, depicting a stitch error in the form of an overlap between adjacent swaths;

FIG. 7 is a plan view, generally similar to FIG. 4, depicting a stitch error in the form of a lightened region between adjacent swaths;

FIG. 8 is a plan view, generally similar to FIG. 4, depicting the technique of the invention as applied to adjacent swaths; and FIG. 9 is plan view, generally similar to FIG. 4, depicting the technique of the invention as applied to adjacent swaths while simultaneously using plural print heads.

DETAILED DESCRIPTION OF THE PREFERRED EMBODIMENTS

Figure 1:
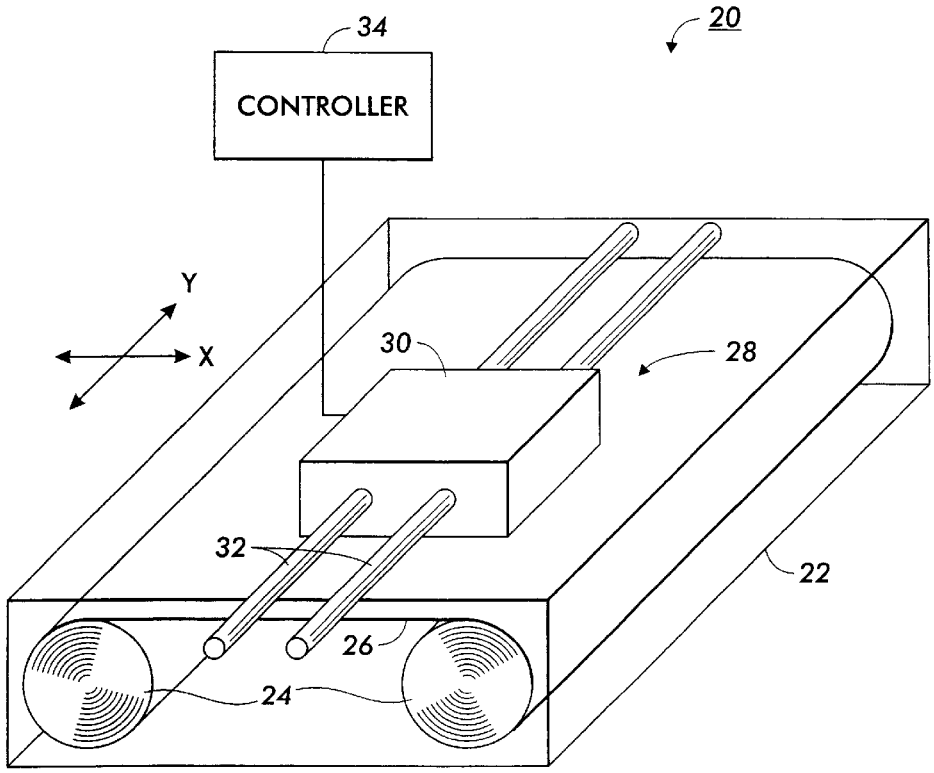
FIG. 1 is a perspective diagrammatic view illustrating an exemplary printing device embodying the present invention.

Turn now to the drawings and, initially, to FIG. 1 which generally illustrates an exemplary printing device 20 in the form of an ink jet printer which embodies the present invention. Although the present invention will be described with reference to the embodiments shown in the drawings, it should be understood that the present invention can be embodied in many alternate forms or embodiments. In addition, any size, shape or type of elements or materials suitable for the invention might be used.

The printing device. 20, specifically an ink jet printer, includes a frame 22 housing a media transport assembly 24. The media transport assembly 24 feeds media 26, such as individual sheets or continuous rolls of paper through a printing flat zone, designated generally as 28, in a first direction along a media feed axis X. A carriage assembly 30 is driven, by a suitable drive mechanism such as a motor (not shown), transversely across the printing flat zone on one or more guide rails 32 in both directions along a carriage scan axis Y.

A controller 34 controls the operation of the media transport assembly 24 and the carriage assembly 30 to cause ink to be printed or otherwise deposited on the medium 26 from one or more arrays of print nozzles or jets that are associated with the carriage assembly 30, as the medium is advanced in a direction along the media feed axis X.

The technique of one embodiment of the invention will initially be described with the aid of FIG. 2. In this instance, fluid ejecting apparatus 36 incorporated into the carriage assembly 30 includes a print head 38 including at least one die 40 having a plurality of nozzles 42 for firing drops of a fluid at the medium 26 to form spots 44 on the medium.

An operator in the form of the media transport assembly 24 serves to move the carriage assembly 30, and therefore the print head 38 in a first direction Y relative to the medium 26. The controller 24 is operable for causing the firing of a first plurality of drops of the fluid at the medium 26 from the nozzles 42 in a first firing sequence while the print head moves relative to the medium depositing the spots 44 on the medium and producing a first swath 46.

Turning now to FIG. 3, the media transport assembly 24 is then effective to advance the medium 26 in a second direction X which is substantially perpendicular to the first direction Y. Thereupon, after the medium 26 advances in the direction X a distance which is approximately that of the width of the swath 46, viewing FIG. 3, the controller 24 is again operable, now viewing FIG. 4, for firing a second plurality of drops of the fluid at the medium 26 from the nozzles 42. Simultaneously, the controller 24 operates to randomly modulate the spot size resulting from the drops of fluid while the print head 38 moves relative to the medium 26 in at least a second swath 48 adjacent the first swath 46.

This operation of random modulation of the spot size and reason for randomly modulating the spot size will be described momentarily. It must first be explained that stitch errors often occur between the drop of the first plurality of drops, that is, the first swath 46, and the drop of the second plurality of drops, that is, the second swath 48. Broadly, a stitch error is a misplacement of the second swath 48 relative to the first swath 46 or a disparity in drop size between the two swaths.

In one specific instance, for example, viewing FIG. 5, a stitch error is a gap 50 between the first swath 46 and the second swath 48. In another specific instance, viewing FIG. 6, a stitch error is an undesired overlap 52 of a first swath 46*a* and a second swath 48*a*. In yet another specific instance, viewing FIG. 7, a stitch error is a lightened region 54 of one swath 46*b*, possibly caused by nozzles 42 which fire weakened jets or drops, juxtaposed with a darkened region of another swath 48*b*. As earlier mentioned, the technique of the invention is to program the controller 34 such that, in each instance of a stitch error, at least the second plurality of drops ejected from the print head 38 include a random variety of drop sizes so as to obscure the stitch error perceived by the eye of a viewer. Thus, as seen in FIG. 8, the gap 50 seen in FIG. 5 is obscured by the random distribution of drops of smaller size which result in smaller spots 56 randomly distributed among the full size spots 44. Also, according to the invention, the spot sizes which are randomly modulated can be taken from a completely available number of drop sizes or, in the alternative, the spot sizes which are randomly modulated can be taken from a restricted portion of a completely available number of drop sizes. The end result is that, in FIG. 8 as compared with FIG. 5, there is minimal recognition in the mind of a viewer of any gap existing between adjacent modified swaths 46*c* and 48*c*.

FIGS. 7 and 9 illustrate that the conditions which warrant the invention can occur when a print head with multiple dies 40 is operated for the printing process. In FIG. 9, the random drop modulation is indicated by reference numeral 58 to obscure the defective lightened 54. It will also be appreciated that the technique of the invention can also be used when a single print head is operable to print an entire page at one time. While preferred embodiments of the invention have been disclosed in detail, it should be understood by those skilled in the art that various other modifications may be made to the illustrated embodiments without departing from the scope of the invention as described in the specification and defined in the appended claims.

What is claimed is:

1. A method of ejecting a fluid at a medium comprising the steps of:

(a) moving in a first direction a print head including at least one die having a plurality of nozzles for firing drops of the fluid at the medium to form spots thereon;

(b) during step (a), firing a first plurality of drops of the fluid at the medium from the plurality of nozzles in a first firing sequence while the print head moves relative to the medium in a first swath;

(c) after step (b), advancing the medium in a second direction substantially perpendicular to the first direction;

(d) after step (c), moving the print head again in the first direction;

(e) during step (d), firing a second plurality of drops of the fluid at the medium from the plurality of nozzles in a second firing sequence while the print head moves relative to the medium in a second swath adjacent the first swath; and (f) randomly modulating the spot size resulting from the drops of the fluid at least during step (e);

whereby a stitch error occurring between the first plurality of drops and the second plurality of drops is obscured.

2. The method of claim 1 wherein the first plurality of drops are fired during a first pass of the print head, and wherein the second plurality of drops are fired from the plurality of nozzles during a second pass of the print head after the first pass of the print head.

3. The method of claim 1 wherein the stitch error is a misplacement of the second swath relative to the first swath; and wherein at least the second plurality of drops include a random variety of drop sizes resulting from step (e) to obscure the stitch error perceived by the eye of a viewer.

4. The method of claim 3 wherein the stitch error is a gap between the first swath and the second swath.

5. The method of claim 4 wherein at least step (e) includes the step of:

randomly modulating the spot size from a completely available number of drop sizes.

6. The method of claim 4 wherein at least step (e) includes the step of:

(e) randomly modulating the spot size from a restricted portion of a completely available number of drop sizes.

7. The method of claim 3 wherein the stitch error is an undesired overlap of the first swath and the second swath.

8. The method of claim 7 wherein at least step (e) includes the step of:

randomly modulating the spot size from a completely available number of drop sizes.

9. The method of claim 7 wherein at least step (e) includes the step of:

randomly modulating the spot size from a restricted portion of a completely available number of drop sizes.

10. The method of claim 1 wherein the stitch error is a lightened region of one swath juxtaposed with a darkened region of another swath.

11. The method of claim 10 wherein at least step (e) includes the step of:

(f) randomly modulating the spot size from a completely available number of drop sizes.

12. The method of claim 10 wherein at least step (e) includes the step of:

(g) randomly modulating the spot size from a restricted portion of a completely available number of drop sizes.

13. The method of claim 1 wherein at least step (e) includes the step of:

(h) randomly modulating the spot size from a completely available number of drop sizes.

14. The method of claim 1 wherein at least step (e) includes the step of:

(i) randomly modulating the spot size from a restricted portion of a completely available number of drop sizes.

15. A fluid ejecting apparatus comprising:

a print head including at least one die having a plurality of nozzles for firing drops of a fluid at a medium to form spots thereon;

an operator for moving the injection head in a first direction relative to the medium producing a first swath; and a controller operable for firing a first plurality of drops of the fluid at the medium from the plurality of nozzles in a first firing sequence while the print head moves relative to the medium, the controller operable, after advancement of the medium in a second direction substantially perpendicular to the first direction, for firing a second plurality of drops of the fluid at the medium from the plurality of nozzles and for randomly modulating the spot size resulting from the drops of fluid while the print head moves relative to the medium in at least a second swath adjacent the first swath;

whereby a stitch error occurring between the drop of the first plurality of drops and the drop of the second plurality of drops is obscured.

16. The fluid ejecting apparatus of claim 15 wherein the controller is operable for completely randomly modulating the spot size from the completely available range of drop sizes.

17. The fluid ejecting apparatus of claim 15 wherein the controller is operable for randomly modulating the spot size from a restricted portion of the completely available range of drop sizes.

18. The fluid ejecting apparatus of claim 15 wherein the stitch error is a misplacement of the second swath relative to the first swath; and wherein the controller is operable for randomly modulating the spot size from at least the second plurality of drops to obscure the stitch error perceived by the eye of a viewer.

19. The fluid ejecting apparatus of claim 18 wherein the stitch error is a gap between the first swath and the second swath.

20. The fluid ejecting apparatus of claim 19 wherein the controller is operable for randomly modulating the spot size from a completely available number of drop sizes.

21. The fluid ejecting apparatus of claim 19 wherein the controller is operable for randomly modulating the spot size from a restricted portion of a completely available number of drop sizes.

22. The fluid ejecting apparatus of claim 18 wherein the stitch error is an undesired overlap of the first swath and the second swath.

23. The fluid ejecting apparatus of claim 22 wherein the controller is operable for randomly modulating the spot size from a completely available number of drop sizes.

24. The fluid ejecting apparatus of claim 22 wherein the controller is operable for randomly modulating the spot size from a restricted portion of a completely available number of drop sizes.

25. The fluid ejecting apparatus of claim 18 wherein the stitch error is a lightened region of one swath juxtaposed with a darkened region of another swath.

26. The fluid ejecting apparatus of claim 25 wherein the controller is operable for randomly modulating the spot size from a completely available number of drop sizes.

27. The fluid ejecting apparatus of claim 25 wherein the controller is operable for randomly modulating the spot size from a restricted portion of a completely available number of drop sizes.

28. A method of ejecting a fluid at a medium comprising the steps of:

(a) moving the medium in a first direction relative to a print head including at least two dies, each die having a plurality of nozzles for firing drops of the fluid at the medium to form spots thereon;

(b) during step (a), firing a plurality of drops of the fluid at the medium from the plurality of nozzles in the at least two dies while the medium moves relative to the print head, the relative movement between the medium and that at least two dies producing a swath for each die; and (c) randomly modulating the spot size resulting from the drops of the fluid;

whereby a stitch error occurring between neighboring swaths is obscured.

29. The method of claim 28 wherein the stitch error is a misplacement of one swath relative to another swath; and wherein at least the plurality of drops producing one swath include a random variety of drop sizes to obscure the stitch error perceived by the eye of a viewer.

30. The method of claim 29 wherein the stitch error is a gap between one swath and a neighboring swath.

31. The method of claim 30 wherein step (c) includes the step of:

(d) randomly modulating the spot size from a completely available number of drop sizes.

32. The method of claim 30 wherein step (c) includes the step of:

(d) randomly modulating the spot size from a restricted portion of a completely available number of drop sizes.

33. The method of claim 29 wherein the stitch error is an undesired overlap of the first swath and the second swath.

34. The method of claim 33 wherein step (c) includes the step of:

(d) randomly modulating the spot size from a completely available number of drop sizes.

35. The method of claim 33 wherein step (c) includes the step of:

(d) randomly modulating the spot size from a restricted portion of a completely available number of drop sizes.

36. The method of claim 28 wherein the stitch error is a lightened region of one swath juxtaposed with a darkened region of an adjacent swath.

37. The method of claim 36 wherein step (c) includes the step of:

(d) randomly modulating the spot size from a completely available number of drop sizes.

38. The method of claim 36 wherein step (c) includes the step of:

(d) randomly modulating the spot size from a restricted portion of a completely available number of drop sizes.

39. The method of claim 28 wherein step (c) includes the step of:

(d) randomly modulating the spot size from a completely available number of drop sizes.

40. The method of claim 28 wherein step (c) includes the step of:

(d) randomly modulating the spot size from a restricted portion of a completely available number of drop sizes.

41. A fluid ejecting apparatus comprising:

a print head including at least two dies, each die having a plurality of nozzles for firing drops of a fluid at a medium to form spots thereon;

an operator for moving the medium relative to the print head; and a controller operable for firing a plurality of drops of the fluid at the medium from the plurality of nozzles in the at least two dies while the medium moves relative to the print head, the relative movement between the medium and that at least two dies producing a swath for each die, the controller operable for randomly modulating the spot size resulting from the drops of fluid;

whereby a stitch error occurring between neighboring swaths is obscured.

42. The fluid ejecting apparatus of claim 41 wherein the controller is operable for completely randomly modulating the spot size from the completely available range of drop sizes.

43. The fluid ejecting apparatus of claim 41 wherein the controller is operable for randomly modulating the spot size from a restricted portion of the completely available range of drop sizes.

44. The fluid ejecting apparatus of claim 41 wherein the stitch error is a misplacement of the second swath relative to the first swath; and wherein the controller is operable for randomly modulating the spot size from at least the second plurality of drops to obscure the stitch error perceived by the eye of a viewer.

45. The fluid ejecting apparatus of claim 44 wherein the stitch error is a gap between the first swath and the second swath.

46. The fluid ejecting apparatus of claim 45 wherein the controller is operable for randomly modulating the spot size from a completely available number of drop sizes.

47. The fluid ejecting apparatus of claim 45 wherein the controller is operable for randomly modulating the spot size from a restricted portion of a completely available number of drop sizes.

48. The fluid ejecting apparatus of claim 44 wherein the stitch error is an undesired overlap of the first swath and the second swath.

49. The fluid ejecting apparatus of claim 48 wherein the controller is operable for randomly modulating the spot size from a completely available number of drop sizes.

50. The fluid ejecting apparatus of claim 48 wherein the controller is operable for randomly modulating the spot size from a restricted portion of a completely available number of drop sizes.

51. The fluid ejecting apparatus of claim 44 wherein the stitch error is a lightened region of one swath juxtaposed with a darkened region of another swath.

52. The fluid ejecting apparatus of claim 51 wherein the controller is operable for randomly modulating the spot size from a completely available number of drop sizes.

53. The fluid ejecting apparatus of claim 51 wherein the controller is operable for randomly modulating the spot size from a restricted portion of a completely available number of drop sizes.

* * * * *